United States Patent [19]

Ibrahim

[11] 4,106,305

[45] Aug. 15, 1978

[54] OPEN WELL TYPE REFRIGERATED DISPLAY CASE WITH REVERSE FLOW OF AIR BANDS

[76] Inventor: Fayez F. Ibrahim, 830 Skyline Dr., Niles, Mich. 49120

[21] Appl. No.: 793,592

[22] Filed: May 4, 1977

Related U.S. Application Data

[63] Continuation of Ser. No. 703,225, Jul. 7, 1976, abandoned, which is a continuation of Ser. No. 564,256, Apr. 2, 1975, abandoned.

[51] Int. Cl.[2] ..... F25D 17/06; A47F 3/04

[52] U.S. Cl. ..... 62/89; 62/256

[58] Field of Search ..... 62/249, 256, 89; 98/36

[56] References Cited

U.S. PATENT DOCUMENTS

| | | | |
|---|---|---|---|
| 2,494,480 | 1/1950 | MacMaster | 62/256 |
| 2,911,799 | 11/1959 | Guyton et al. | 62/256 |
| 3,333,437 | 8/1967 | Brennan | 62/256 |
| 3,365,908 | 1/1968 | MacMaster | 62/256 |
| 3,517,526 | 6/1970 | MacMaster et al. | 62/256 |
| 3,528,258 | 9/1970 | Brennan | 62/256 |
| 3,543,532 | 12/1970 | Gatton et al. | 62/256 |
| 3,756,038 | 9/1973 | MacMaster et al. | 62/256 |
| 3,771,323 | 11/1973 | Simons et al. | 62/256 |

*Primary Examiner*—Lloyd L. King

*Attorney, Agent, or Firm*—LeBlanc & Shur

[57] ABSTRACT

An open well type refrigerated display case for low temperature application having reverse flow of refrigerated air access the access opening in the top of the display case to produce the lowest temperatures toward the front of the display case. Multiple horizontal air bands are circulated across the opening provided in the top of the display case to dissipate radiant heat impinging on the product displayed in the case, with the inner air band being refrigerated and the outer air band being partially refrigerated and dehumidified. Dehumidification of the outer air band is achieved by aluminum fins provided in a lower portion of the duct work which conducts the outer air band.

12 Claims, 1 Drawing Figure

OPEN WELL TYPE REFRIGERATED DISPLAY CASE WITH REVERSE FLOW OF AIR BANDS

This is a continuation, of application Ser. No. 703,225 filed July 7, 1976 now abandoned which is a continuation of Ser. No. 564,256, filed Apr. 2, 1975, now abandoned.

BACKGROUND OF THE INVENTION

1. Field of the Invention

Refrigerated display cases of the open well type generally are used for low temperature applications. Access to produce displayed in the case is provided by an opening in the top wall of the case. Typically, air flow across the access opening of the case is from rear to front, with the coldest temperatures in the case being at the rear of the well. Thus the coldest product on display is furthest from the customer.

Because of the location of the access opening, a serious problem in cases of the top display type is the effect radiant heat has on the product. Radiant heat generally travels in straight lines and emanates from either the ceiling or from lights placed directly above the case. Tests have shown that radiant energy can cause the product displayed in a case having a top access opening to be 10° to 20° Fahrenheit (F.) higher than the air temperature traveling over the product.

To negate the effects of radiant heat requires a flow of air perpendicular to the radiant effect to carry radiant heat away from the product faster than it can be input. Thus it is necessary to increase the velocity of the flow of refrigerated air across the access opening to dissipate radiant heat. However, with a single air curtain, an increase in the air velocity of the refrigerated air results in an excessive amount of aspiration with ambient air. Using a double air band in which the inner band is refrigerated and the outer band is unrefrigerated permits increasing the velocity of air flow across the products. The outer air band preserves the integrity of the inner refrigerated air band flowing across the access opening. The use of two air bands, including an outer unrefrigerated air band, permits the use of a high velocity air flow for the two air bands which operates effectively to dissipate the effect of radiant energy and thus maintain the integrity of the product.

2. Prior Art

It should be recognized that the use of multiple air curtains in refrigerated display cases is well known in the art. The broad general concept of having a plurality of streams of air flowing across the display case with the outermost layer or layers of air being an unrefrigerated type is illustrated in the following U.S. Pat. Nos.: Re. 25,735 — Lamb, 3,063,252 — Lamb, 3,082,612 — Beckwith, 3,094,851 — Beckwith, 3,130,559 — Beckwith, 3,528,258 — Brennan. However, it should be noted that in all of the above patents, the display cases were of the upright type in which the problem posed by radiant energy is minimal. Further, the streams of air flowing into such upright display cases was from the top to the bottom of the case to thus form a substantially vertical air curtain.

Of particular interest is the following U.S. Pat. No.: 3,324,676 — Gerweck. In the above U.S. patent the patent drawing suggests a possible horizontal orientation of a portion of the air curtains but it is not clear that the air flow would be as displayed in FIG. 1 of the drawing because the flow of air would not be constrained to follow the contour of the side wall of the case but rather would flow from outlets 54 and 56 across the access opening provided in the case to inlet 42 and along a substantially vertical path. Although Gerweck discloses two air curtains, the outer one being ambient air and the inner one being refrigerated air, the reference illustrates an upright display case in which the problem of radiant energy is minimal and there is no suggestion that the use of a horizontal air curtain in the subject case is desired or intended. Further, it is not clear that the patent is operative to produce a horizontal air curtain in that it would appear very difficult to change the outer air curtain from a vertical to a horizontal curtain where the refrigerated air from the chamber 24 impinges on the vertically flowing ambient air.

SUMMARY OF THE INVENTION

The present invention relates to an open well type display case having a top access opening. Particularly, it relates to the use of a reverse flow, that is, from the front to the rear of the case, of refrigerated air to provide the coldest temperatures at the front of an open well display case so that the coldest product displayed in case is closest to the customer.

Further, multiple air curtains are provided to dissipate the effect of radiant energy on products displayed in the case. The invention provides for an inner air band of refrigerated air flowing horizontally across the top access opening of the display case and a second or outer air band of unrefrigerated air flowing horizontally across the top access opening in the case. The double air band is effective to dissipate radiant energy and maintain the temperature of the product displayed in the case at an acceptable low level. The use of a single air band to carry away radiant energy would result in an excessive amount of aspiration with the ambient store air. The use of an unrefrigerated outer air band protects the inner refrigerated air band and enables the use of relatively high velocity air to improve the efficiency of the refrigerated display case in dissipating radiant energy.

The use of a reverse flow of refrigerated air and two air bands in an open well type display case results in a reduced number of defrosts and the duration of defrosts is decreased because of the reduced aspiration of ambient air with the refrigerated air of the inner air band. Further, in the display case of the present invention no insulation is provided between the inner refrigerated air band and the outer ambient air band. Thus, the two air bands are separated by merely a metal wall and heat will transfer through the metal separating the bands, with the outer band becoming refrigerated and partially dehumidified due to frost accumulation on the surface of the metal walls. Partial refrigeration of the outer air band would improve the ability of that outer air band to preserve the integrity of the refrigerated inner band.

OBJECTS OF THE INVENTION

It is an object of the present invention to provide an improved refrigerated display case of the open well type.

Another object of the present invention is to provide means for producing a reverse flow of refrigerated air across the product in an open well refrigerated display case having a top access opening, thus placing the coldest product in closest proximity to the front of the case for easier access by the consumer.

It is another object of the present invention to provide means for dissipating the radiant energy which reduces the efficiency of an open well type refrigerated display case having a top access opening.

A further object of the present invention is to provide within an open well type refrigerated display case having a top access opening multiple horizontal air curtains including an inner refrigerated air curtain flowing horizontally across the opening in the top of the display case and an outer air curtain of unrefrigerated or ambient air flowing horizontally across the access opening adjacent the inner air band.

A further object of the present invention is to provide means for partially refrigerating the outer air band of the display case, thereby improving the ability of the outer air band to preserve the integrity of the inner refrigerated air band.

Other objects of the present invention will become apparent on inspection of the drawing and reading of the specification and will be pointed out in the appended claims.

BRIEF DESCRIPTION OF THE DRAWINGS

The FIGURE in the drawing represents a cross-section of a refrigerated display case constructed in accordance with the present invention.

DETAILED DESCRIPTION OF THE PRESENT INVENTION

Figure 1:
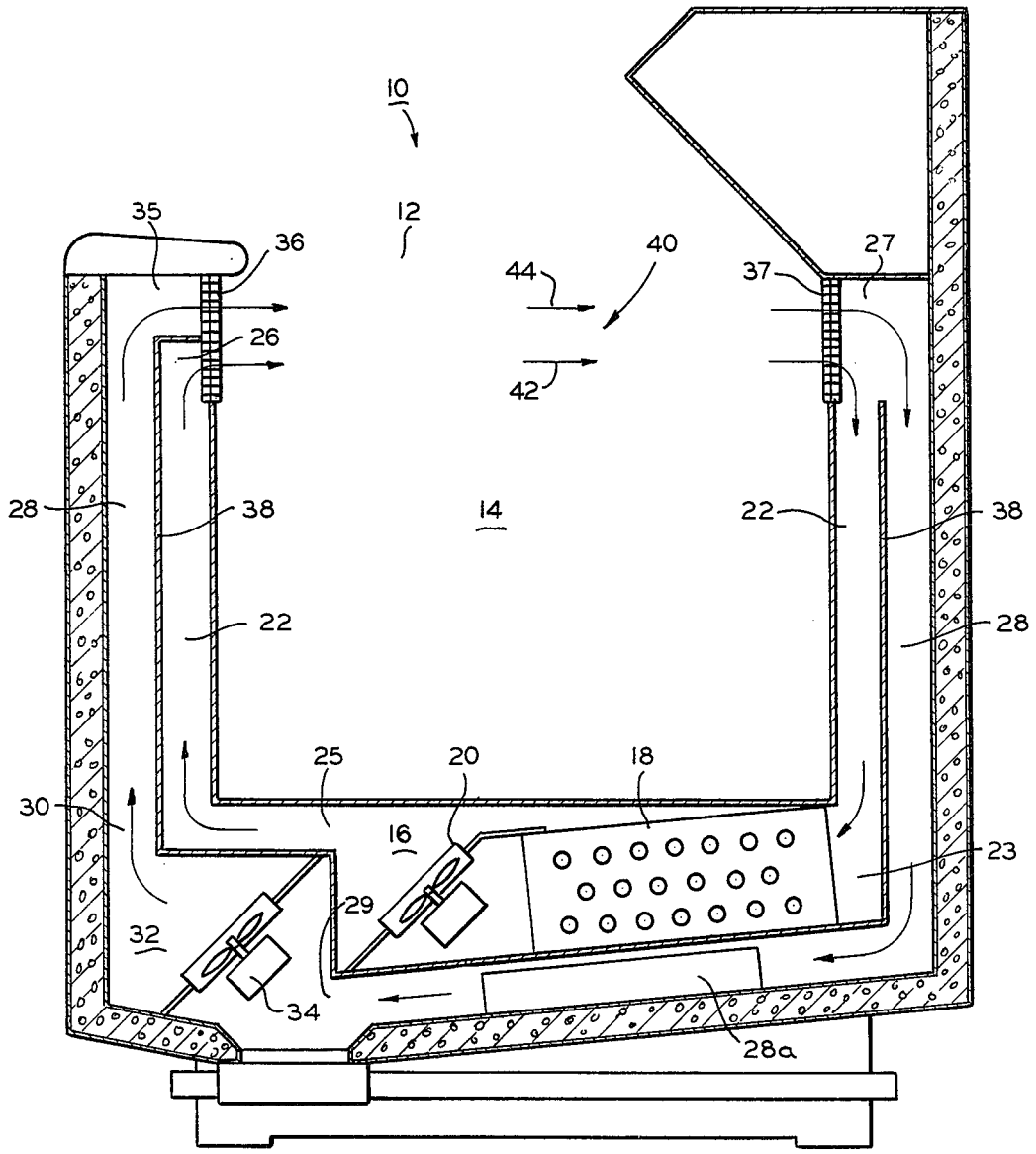

Referring now specifically to the drawing and to details of the preferred embodiment of the present invention, a refrigerated display case 10 of the open well type typically used for low temperature applications has provided therein a top access opening 12 which provides access to products placed in the refrigerated space 14.

Provided beneath the display space 14 is a plenum chamber 16 wherein a refrigerating element or evaporator coil 18 is mounted. Mounted in the plenum chamber 16 adjacent the evaporator 18 is a blower or fan 20. A first or inner air duct 22 has a lower inlet opening 23 to the plenum chamber 16 adjacent the evaporator coil 18 and a lower outlet opening 25 adjacent the fan 20.

The inner air duct 22 also has an upper outlet or discharge opening 26 and an upper inlet opening 27. A second or outer air duct 28 lies outward of and adjacent to the inner air duct 22 and the plenum chamber 16. The outer air duct has respective lower inlet and outlet openings 29 and 30 connected to a plenum chamber 32 which lies forward of the plenum chamber 16. A blower or fan 34 is mounted in the plenum chamber 32. An upper air outlet or discharge opening 35 is provided adjacent the front outer edge of the access opening 12. The upper inlet opening 27 also serves as an inlet for air flowing from the outlet 35. Grids 36 and 37, provided at respective upper outlets and inlets, direct the flow of air across the access opening 12.

The fan 20 draws air down the air duct 22 through the lower inlet opening 23 across the evaporator coil 18 into the plenum chamber 16 and out the lower outlet opening 25 to the upper discharge opening 26. The fan 34 mounted in the plenum chamber 32 draws ambient air through the outer air duct 28 into the plenum chamber 32 and discharges the ambient air along the front side of the air duct 28 and through the upper discharge opening 35.

Within a lower portion of the outer air duct 28 is mounted a series of spaced fins 28*a*, preferably fabricated from aluminum, to dehumidify air circulating through the duct 28. The inner air duct 22 and the outer air duct 28 are separated only by a thin metal wall 38.

The operation of the invention shown in the drawing is as follows:

Air is drawn into the inner duct 22 through the upper inlet opening 27 along the rear portion of the inner duct 22 to the lower inlet opening 23 of the plenum chamber 16. The incoming air is refrigerated as it is drawn across the evaporator coil 18 mounted in the plenum chamber 16. The fan 20 draws the incoming air across the evaporator coil 20 and discharges the refrigerated air through the lower outlet opening 25. The discharged refrigerated air is carried along the front portion of the air duct 22 to an upper discharge opening 26 which discharges the outlet refrigerated air across the access opening 12 in a substantially horizontal plane, the discharge air to be received in the upper inlet opening 27 for recirculation through the air duct 22.

As refrigerated air is circulated through the inner air duct 22, unrefrigerated air is circulated through the outer air duct 28 simultaneously and in the following manner: Ambient air is drawn into the upper inlet opening 27 of the outer air duct 28 and carried along a rear portion of the outer air duct 28 to the inlet opening 29 of the plenum chamber 32. The fan 34 mounted in the plenum chamber 32 draws the ambient air through the chamber 32 and discharges the air through the lower outlet opening 30 along the front portion of the outer air duct 28, and discharges the air through an upper air outlet opening 35. The discharged ambient air also passes across the access opening 12 in a substantially horizontal plane and is received in the upper inlet opening 27 of the air ducts 22 and 28.

Because the inner air duct 22 and the outer air duct 28 are separated only by a thin metal wall 38, the two air ducts are in heat exchanging relationship, thus permitting the outer air duct to be partially refrigerated by an accumulation of frost on the metal wall 38 which provides one inner surface of the air duct 28. Frost would also accumulate on the dehumidification fins provided in the outer duct 28 to assist lowering the temperature therein. Note however that no refrigerating means is provided in the lower plenum chamber 32 and thus the temperature of the air circulating in the air duct 28 remains substantially higher than the temperature of the air circulating in the inner air duct 22. However, the temperature differential between the air circulating in the outer air duct 28 and the ambient air outside the case does help to preserve the integrity of the inner refrigerated air curtain and prevent excessive aspiration of refrigerated air outside the display case 10.

The air flowing from the ducts 22 and 28 establishes an air curtain 40 across the top access opening 12 provided in the case which performs a dual purpose; first, the air curtain 40 serves to dissipate radiant heat produced by lights provided outside the case and second, the air curtain 40 opposes the entry of warm, moist ambient air through the access opening 12 into the display space 14. The air flowing from the discharge openings 26 and 35 is directed rearwardly in two parallel layers 42 and 44 across the top access opening 12 to the return air inlet 27 provided in the rear of the case.

It can easily be seen that the present invention provides an open well display case wherein the coldest air and thus the coldest product is provided at the front of the case, thus placing the coldest product nearest to the customer. Further, the present invention provides a means of dissipating radiant heat which is a particular problem in a display case of the open well type wherein an air curtain of refrigerated air flows across the access opening of the display case in closest proximity to the product and an outer air curtain of partially refrigerated air flows across the access opening of the display case in closest proximity to the ambient air, the outer air curtain being partially refrigerated and dehumidified and serving to preserve the integrity of the inner air curtain. This system of air curtains serves to dissipate radiant heat impinging on products displayed in the case.

Thus having described the preferred embodiment of the present invention, it will be, of course, understood that various changes may be made in the form, arrangements and proportions of the products without parting from the scope of the invention which consists of the matter shown and described herein and set forth in the appended claims.

I claim:

1. An open well multiple horizontal air curtain type refrigerated product display case comprising:

a. an access opening in a top wall of said display case providing access to a display space;

b. an inner air passage adjacent to and substantially surrounding the bottom and sides of said display space, with said inner air passage also including cooling means;

c. a separate outer air passage provided outwardly of and adjacent to said inner air passage, said outer air passage being in heat exchanging relation with said inner air passage whereby said cooling means also partially cools the air in said outer passage;

d. each of said inner and outer air passages having front and rear end portions, with said front end portions terminating adjacent a front edge of said access opening and said rear end portions terminating at a rear edge of said access opening, said front and rear end portions being substantially horizontally aligned;

e. air propulsive means in each of said inner and outer air passages to respectively propel flows of air through each of said air passages and across said access opening in independent substantially horizontal inner and outer air curtains from the front edge to the rear edge of said access opening; and f. guide means provided at the front and rear end portions of said air passages for directing said air curtains across said access opening, whereby the front-to-rear directional flow of said air curtains generate the coolest temperatures in said display case along the front edge thereof, with the use of said cooled inner air curtain and said partially cooled outer air curtain permitting the use of high velocity air curtains without excessive aspiration with ambient air which in turn permits the removal of radiant heat by said air curtains at a rate greater than the input rate of said radiant heat to thus maintain the integrity of said refrigerated product.

2. The product display case of claim 1, wherein said outer air passage includes a plurality of generally horizontally extending vertical heat conducting metal fins that are fixedly attached to a bottom wall portion of said product display case, said fins serving to at least partially dehumidify said outer air curtain so as to in turn enhance the integrity of said inner air curtain thereby reducing the number and duration of defrost cycles.

3. The product display case of claim 2, wherein said front end portion comprises a separate horizontally directed outlet for each of said inner and outer air passages and said rear end portion comprises a common, vertically opening inlet for the flows from the air curtains whereby the cooled inner curtain air and the partially cooled outer curtain air at least partially mix before reentering said passages for recirculation.

4. The product display case of claim 3, wherein the air propulsion means comprises a first fan mounted in the bottom portion of the inner passage downstream said cooling means and a second fan mounted on the bottom portion of the outer passage downstream said metal fins whereby air entering said passages is drawn, respectively, through said cooling means and said fins before being propelled through said outlets.

5. A method for cooling an open well refrigerated product display case having a bottom portion and upstanding front, rear, and side portions which define a horizontal access opening to display space comprising:

providing an inner air passage adjacent to and substantially surrounding the bottom and sides of said display space, and providing cooling means mounted in said inner air passage;

providing a separate outer air passage outwardly of and adjacent to said inner air passage, said outer air passage being in heat exchanging relation with said inner air passage whereby said cooling means also partially cools the air in said outer passage;

each of said inner and outer passages having front and rear end portions, with said front end portion terminating adjacent a front edge of said access opening and said rear end portion terminating at a rear edge of said access opening, said front and rear end portions being substantially horizontally aligned;

directing a cooled flow of air from said inner air passage through the front end portions thereof, across the access opening and into the rear end portion thereof to form a first curtain of cooled air.

directing a flow of partially cooled air from the outer air passage through the front end portions thereof, across the horizontal access opening, and into the rear end portion thereof to form a second upper partially cooled curtain of air over said first curtain of air whereby the front-to-rear directional flow of said air curtains generates the coolest temperatures in said display case along the front edge thereof, with the use of said cooled inner air curtain and said partially cooled outer air curtain permitting the use of high velocity air curtains without excessive aspiration with ambient air which in turn permits the removal of radiant heat by said air curtains at a rate greater than the input rate of said radiant heat to thus maintain the integrity of the refrigerated product.

6. The method of claim 5 further comprising: providing a dehumidifying means in the outer passage, and at least partially dehumidifying the air in said passage before said air is directed through the front end portion thereof to form the second, outer air curtain to thereby enhance the integrity of the inner air curtain and reduce the number and duration of defrost cycles.

7. An open well multiple air curtain type refrigerated product display case comprising:

a. an access opening in a top wall of said display case providing access to a display space;

b. an inner air passage adjacent to and substantially surrounding the bottom and sides of said display space, with said inner air passage also including cooling means;

c. a separate outer air passage provided outwardly of and adjacent to said inner air passage, said outer air passage being in heat exchanging relation with said inner air passage whereby said cooling means also partially cools the air in said outer passage;

d. each of said inner and outer air passages having front and rear end portions, with said front end portions terminating adjacent a front edge of said access opening and said rear end portions terminating at a rear edge of said access opening;

e. air propulsive means in each of said inner and outer air passages to respectively propel flows of air through each of said air passages and across said access opening in substantially independent inner and outer air curtains between the front edge and the rear edge of said access opening; and f. guide means provided at the front end portions of said air passages for directing said air curtains across said access opening, said cooled inner air curtain and said partially cooled outer air curtain permitting the use of high velocity air curtains without excessive aspiration with ambient air which in turn permits the removal of radiant heat by said air curtains at a rate greater than the input rate of said radiant heat to thus maintain the integrity of said refrigerated product.

8. The product display case of claim 7, wherein said outer air passage includes a plurality of heat conducting metal fins located in the air flow path in said outer air passage, said fins serving to at least partially dehumidify said outer air curtain so as to in turn enhance the integrity of said inner air curtain thereby reducing the number and duration of defrost cycles.

9. The product display case of claim 8, wherein said front end portion comprises a separate rearwardly directed outlet for each of said inner and outer air passages and said rear end portion comprises a common inlet for receiving the flows from the air curtains whereby the cooled inner curtain air and the partially cooled outer curtain air at least partially mix before reentering said passages for recirculation.

10. The product display case of claim 9, wherein the air propulsion means comprises a first fan mounted in the inner passage downstream of said cooling means and a second fan mounted in the outer passage downstream of said metal fins whereby air entering said passages is drawn, respectively, through said cooling means and said fins before being propelled through said outlets.

11. A method for cooling an open well refrigerated product display case having a bottom portion, upstanding front, rear, and side portions, and an open top which defines an access opening to a display space in the refrigerated case, the method comprising:

providing an inner air passage adjacent to and substantially surrounding the bottom and sides of said display space, and providing cooling means mounted in said inner air passage;

providing a separate outer air passage outwardly of and adjacent to said inner air passage, said outer air passage being in heat exchanging relation with said inner air passage whereby said cooling means also partially cools the air in said outer passage;

each of said inner and outer passages having front and rear end portions, with said front end portion terminating adjacent a front edge of said access opening and said rear end portion terminating at a rear edge of said access opening;

directing a cooled flow of air from said inner air passage through one end portion thereof, across the access opening and into the other end portion thereof to form a first curtain of cooled air;

directing a flow of partially cooled air from the outer air passage substantially horizontally, across the access opening to form a second partially cooled curtain of air over said first curtain of air thereof, with the use of said cooled inner air curtain and said partially cooled outer air curtain permitting the use of high velocity air curtains without excessive aspiration with ambient air which in turn permits the removal of radiant heat by said air curtains at a rate greater than the input rate of said radiant heat to thus maintain the integrity of the refrigerated product.

12. The method of claim 11, further comprising: providing a dehumidifying means in the outer passage, and at least partially dehumidifying the air in said passage before said air is directed through the front end portion thereof to form the second, outer air curtain to thereby enhance the integrity of the inner air curtain and reduce the number and duration of defrost cycles.

* * * * *